US007073653B2

(12) United States Patent
Hibari

(10) Patent No.: US 7,073,653 B2
(45) Date of Patent: Jul. 11, 2006

(54) COIN HANDLING MACHINE

(75) Inventor: Eiko Hibari, Saitama (JP)

(73) Assignee: Laurel Precision Machines Co., Ltd., Osaka (JP)

( * ) Notice: Subject to any disclaimer, the term of this patent is extended or adjusted under 35 U.S.C. 154(b) by 202 days.

(21) Appl. No.: 10/644,478

(22) Filed: Aug. 20, 2003

(65) Prior Publication Data

US 2004/0035673 A1 Feb. 26, 2004

(30) Foreign Application Priority Data

Aug. 22, 2002 (JP) ..... 2002-241314

(51) Int. Cl.
*G07D 5/00* (2006.01)

(52) U.S. Cl. ..... 194/302

(58) Field of Classification Search ..... 194/293, 194/302, 303, 317, 320, 325, 328, 344; 453/18, 453/56; 382/136
See application file for complete search history.

(56) References Cited

U.S. PATENT DOCUMENTS

| | | | | |
|---|---|---|---|---|
| 4,441,516 | A * | 4/1984 | Stadler et al. | 453/30 |
| 4,681,204 | A | 7/1987 | Zimmerman | |
| 5,135,433 | A * | 8/1992 | Watanabe et al. | 453/3 |
| 5,207,611 | A | 5/1993 | Ueda et al. | |
| 5,230,653 | A | 7/1993 | Shinozaki et al. | |
| 5,662,205 | A * | 9/1997 | Levasseur | 194/317 |
| 5,673,781 | A * | 10/1997 | Costello et al. | 194/317 |
| 6,431,342 | B1 | 8/2002 | Schwartz | |

FOREIGN PATENT DOCUMENTS

| | | | |
|---|---|---|---|
| EP | 0 660 274 | A1 | 6/1995 |
| EP | 1 205 886 | A2 | 5/2002 |
| EP | 1.205.886 | A2 * | 5/2002 |

* cited by examiner

*Primary Examiner*—Eileen D. Lillis
*Assistant Examiner*—Mark J. Beauchaine
(74) *Attorney, Agent, or Firm*—Cohen, Pontani, Lieberman & Pavane

(57) ABSTRACT

A coin handling machine includes a coin sorting passage formed with a reference guide rail, a sensor for detecting optical properties and magnetic properties of the coins, a coin sorting opening along the inner wall of the reference guide rail and a coin sorting member provided in the vicinity of a side portion of the coin sorting opening on the side of the reference guide rail, the coin sorting member including a coin supporting section having a coin supporting surface for supporting one edge portion of the coin being transported in the coin sorting passage and a coin press section for pressing the coin, and it further includes a rotary solenoid for moving the coin supporting section between a coin support position where the coin supporting surface can support one edge portion of the coin being transported in the coin sorting passage and a retracted position where the coin supporting surface cannot support the coin and moving the coin press section so as to press the coin downward in synchronism with the movement of the coin supporting surface to the retracted position and a controller for driving the rotary solenoid based on detection signals from the sensor.

The thus constituted coin handling machine can reliably drop a predetermined coin among coins fed into the coin sorting passage in the coin sorting opening, thereby sorting it without making the machine large.

29 Claims, 11 Drawing Sheets

COIN HANDLING MACHINE

BACKGROUND OF THE INVENTION

The present invention relates to a coin handling machine and, particularly, to such a machine which can reliably drop a predetermined coin among coins fed into a coin sorting passage in a coin sorting opening formed in the coin sorting passage, thereby sorting it without making the machine large.

DESCRIPTION OF THE PRIOR ART

There is known a coin handling machine in which a plurality of coin sorting openings are formed in a coin sorting passage so that a coin sorting opening formed upstream has smaller diameter that of a coin sorting opening formed downstream and which is adapted to drop coins in the plurality of coin sorting openings so that coins having a smaller diameter drop in a coin sorting opening ahead of coins having a larger diameter, thereby sorting them.

However, in this coin handling machine it is indispensable to form a coin sorting passage with coin sorting openings in a number equal to the number of denominations of coins to be handled and, therefore, the size of the machine inevitably becomes large.

Therefore, U.S. Pat. No. 4,681,204 proposes a coin handling machine in which at least one coin sorting opening is formed in a coin sorting passage and a coin sorting member projectable into the coin sorting passage is provided and which is constituted so as to move the coin sorting member in the widthwise direction of the coin sorting passage when a predetermined coin is detected by a sensor provided upstream of the coin sorting opening, thereby projecting it into the coin sorting passage and selectively dropping the predetermined coin in the coin sorting opening, thereby sorting it.

According to this coin handling machine, it is possible to selectively drop only a predetermined coin in the coin sorting opening, thereby sorting it.

However, since this coin handling machine is constituted so as to move the coin sorting member in the widthwise direction of the coin sorting passage, thereby projecting it into the coin sorting passage and selectively drop a predetermined coin in the coin sorting opening, in the case where the interval between a coin to be sorted and the coin preceding the coin to be sorted or the coin following the coin to be sorted is small when coins are transported, the preceding coin or the following coin may be moved by the coin sorting member in the widthwise direction of the coin sorting passage together with the coin to be sorted and dropped in the coin sorting opening. Further, since a transporting belt is moved by the coin sorting member in the widthwise direction of the coin sorting passage together with the coin to be sorted, the preceding coin or the following coin may be moved by the transporting belt in the widthwise direction of the coin sorting passage and dropped in the coin sorting opening. Therefore, coins sometimes cannot be sorted in a desired manner.

Moreover, it is indispensable in this coin handling machine to form the coin sorting opening so that the width thereof in the direction perpendicular to the coin transportation direction is smaller than the diameter of the smallest coin to be handled and equal to or larger than half the diameter of the largest coin to be handled in order to ensure that the smallest coin can pass by the coin sorting opening without being dropped therein when the coin sorting member is not driven and that the largest coin reliably drop in the coin sorting opening when the coin sorting member is driven. Therefore, the diameters of coins to be handled have to be restricted.

Furthermore, since a coin moved in the widthwise direction of the coin sorting passage by the coin sorting member freely falls into the coin sorting opening in this coin handling machine, it is required to form the coin sorting opening so as to be considerably long in the coin transportation direction in order to ensure that a coin to be sorted reliably drops in the coin sorting opening. Therefore, in the case where a plurality of coin sorting openings are formed in the coin sorting passage, the coin sorting passage has to be formed long and in the case where the coin transporting speed is increased in order to improve the coin handling efficiency, the coin sorting passage has to be formed still longer. Accordingly, the coin handling machine inevitably becomes large.

SUMMARY OF THE INVENTION

It is therefore an object of the present invention to provide a coin handling machine which can reliably drop a predetermined coin among coins fed into a coin sorting passage in a coin sorting opening formed in the coin sorting passage, thereby sorting it, without making the machine large.

The above other objects of the present invention can be accomplished by a coin handling machine comprising a rotatable disk for receiving coins deposited into a coin handling machine and feeding out the coins into a coin sorting passage one by one by a centrifugal force produced by rotation of the rotatable disk, a reference guide rail for guiding the coins by an inner wall thereof, transporting belt means for transporting the coins while they are held between the coin sorting passage and themselves, and a sensor for detecting optical properties and magnetic properties of the coins, the coin handling machine further comprising a coin sorting opening formed in the coin sorting passage downstream of the sensor along the inner wall of the reference guide rail and a coin sorting member provided in the vicinity of a side portion of the coin sorting opening on the side of the reference guide rail, the coin sorting member comprising at least one coin supporting section having a coin supporting surface for supporting one edge portion of the coin being transported in the coin sorting passage and at least one coin press section for pressing the coin, the coin handling machine further comprising a coin sorting member driving means for moving the at least one coin supporting section between a coin support position where the coin supporting surface can support one edge portion of the coin being transported in the coin sorting passage and a retracted position where the coin supporting surface is retracted from the coin support position and cannot support the coin and moving the at least one coin press section so as to press the coin downward in synchronism with the movement of the coin supporting surface to the retracted position and a control means for driving the coin sorting member driving means based on detection signals from the sensor and the coin handling machine being constituted so as to forcibly drop the coin supported by the coin supporting surface into the coin sorting opening and sort it.

According to the present invention, the coin handling machine comprises a coin sorting opening formed in the coin sorting passage downstream of the sensor along the inner wall of the reference guide rail and a coin sorting member provided in the vicinity of the side portion of the coin sorting opening on the side of the reference guide rail, coin sorting member comprising at least one coin supporting section having a coin supporting surface for supporting one edge portion of the coin being transported in the coin sorting passage and at least one coin press section for pressing the coin, and the coin handling machine further comprises a coin sorting member driving means for moving the at least one coin supporting section between a coin support position where the coin supporting surface can support one edge portion of the coin being transported in the coin sorting passage and a retracted position where the coin supporting surface is retracted from the coin support position and cannot support the coin and moving the at least one coin press section so as to press the coin downward in synchronism with the movement of the coin supporting surface to the retracted position and a control means for driving the coin sorting member driving means based on detection signals of the sensor. Therefore, it is possible to reliably drop coins to be sorted into the coin sorting opening and sort them because the coin supported by the coin supporting surface can be forcibly dropped into the coin sorting opening by driving the coin sorting member driving means by the control means so as to cause it to move the coin supporting section to the retracted position where the coin supporting surface is retracted from the coin support position and cannot support the coin when the control means detects the coin to be dropped in the coin sorting opening and sorted based on the detection signal from the sensor, thereby releasing the support of the coin by the coin supporting surface, and to move the coin press section so as to push the coin downward in synchronism with the movement of the coin supporting surface to the retracted position.

Further, according to the present invention, since the coin to be sorted can be forcibly dropped into the coin sorting opening, even if the coin preceding the coin to be sorted or the coin following the coin to be sorted is being transported with a short interval between itself and the coin to be sorted, it is still possible to reliably drop only the coin to be sorted into the coin sorting opening, thereby being sorted. Furthermore, since the transporting belt means is not moved by the coin sorting member in the widthwise direction of the coin sorting passage and, therefore, the preceding coin or the following coin is not dropped into the coin sorting opening by the transporting belt means, it is possible to reliably drop coins to be sorted into the coin sorting opening and sort them.

Moreover, according to the present invention, since the coin to be sorted can be forcibly dropped into the coin sorting opening, it is possible to reliably drop the coin to be sorted in the coin sorting opening and sort it without making the coin sorting passage considerably long. Therefore, even when the transporting speed of coins is increased in order to improve the coin handling efficiency, since it is unnecessary to lengthen the coin sorting passage, the coin handling machine can be made markedly small.

In a preferred aspect of the present invention, the coin sorting member comprises a coin supporting section having a coin supporting surface for supporting one edge portion of the coin being transported in the coin sorting passage and a coin press section integrally formed with the coin supporting section above the coin supporting surface and adapted for pressing the coin and the coin sorting member driving means is constituted so as to rotate the coin sorting member about a substantially horizontal axis.

According to this preferred aspect of the present invention, since the coin sorting member comprises a coin supporting section having a coin supporting surface for supporting one edge portion of the coin being transported in the coin sorting passage and a coin press section integrally formed with the coin supporting section above the coin supporting surface and adapted for pressing the coin and the coin sorting member driving means is constituted so as to rotate the coin sorting member about a substantially horizontal axis, it is possible to put the coin in a condition unsupported by the coin supporting surface by rotating the coin sorting member about the substantially horizontal axis when the coin to be dropped into the coin sorting opening and sorted is detected based on the detection signal from the sensor and moving the coin supporting section to the retracted position and to press downward the coin which is no longer supported by the coin supporting surface by the coin press section integrally formed with the coin supporting section above the coin supporting surface, thereby forcibly dropping it into the coin sorting opening. Therefore, it is possible to reliably drop coins to be sorted into the coin sorting opening and sort them.

In a further preferred aspect of the present invention, the coin supporting section includes a side wall portion substantially perpendicular to the coin supporting surface, and the coin sorting opening and the coin sorting member are formed so that when the coin supporting section of the coin sorting member is located at the coin support position, the side wall portion of the coin supporting section is flush with the inner wall of the reference guide rail and a distance between a side portion of the coin sorting opening on the side of the coin sorting passage and the side wall portion of the coin supporting section is smaller than a diameter of the smallest coin to be handled.

According to this preferred aspect of the present invention, since the coin supporting section includes a side wall portion substantially perpendicular to the coin supporting surface, and the coin sorting opening and the coin sorting member are formed so that when the coin supporting section of the coin sorting member is located at the coin support position, the side wall portion of the coin supporting section is flush with the inner wall of the reference guide rail and a distance between a side portion of the coin sorting opening on the side of the coin sorting passage and the side wall portion of the coin supporting section is smaller than a diameter of the smallest coin to be handled, the lower limit of the width of the coin sorting opening in the direction perpendicular to the coin transportation direction is not restricted. Therefore, since no restriction is imposed on diameters of coins to be handled, it is possible to sort coins having diameters greatly different from each other in a desired manner.

In a further preferred aspect of the present invention, the coin sorting member driving means is constituted as a rotary solenoid.

According to this preferred aspect of the present invention, since the coin sorting member driving means is constituted as a rotary solenoid, the coin sorting member can be quickly rotated about the substantially horizontal axis. Therefore, coins can be reliably dropped in the coin sorting opening and sorted by moving the coin supporting section to the retracted position thereof, thereby releasing the support of a coin with the coin supporting surface and pressing downward the coin which is no longer supported by the coin supporting surface with the coin press section integrally mounted on the coin supporting section above the coin supporting surface.

In a further preferred aspect of the present invention, one end portion of an arm whose other end portion has a fan-like cross section is fixed to an output shaft of the rotary solenoid, the coin supporting section includes an engagement portion having a fan-like cross section and formed with a gear and a gear on the engagement portion engages with the gear formed on the other end portion of the arm so that a driving force of the rotary solenoid can be transmitted to the coin sorting section.

In a preferred aspect of the present invention, the coin sorting member includes a cylindrical section and a plurality of coin supporting sections formed on the cylindrical section so as to radially extend, each of the plurality of coin supporting sections including a coin supporting surface for supporting one edge portion of a coin being transported in the coin sorting passage by the transporting belt means when the coin sorting member is located at the coin support position and a coin press section for pressing down the upper surface of the coin when the coin sorting member is moved to the retracted position, and the coin sorting member driving means is constituted so as to rotate the coin sorting member about a substantially horizontal axis.

According to this preferred aspect of the present invention, since the coin sorting member includes a cylindrical section and a plurality of coin supporting sections formed on the cylindrical section so as to radially extend, each of the plurality of coin supporting sections including a coin supporting surface for supporting one edge portion of a coin being transported in the coin sorting passage by the transporting belt means when the coin sorting member is located at the coin support position and a coin press section for pressing down the upper surface of the coin when the coin sorting member is moved to the retracted position, and the coin sorting member driving means is constituted so as to rotate the coin sorting member about a substantially horizontal axis, it is possible to put the coin in a condition unsupported by the coin supporting surface by rotating the coin sorting member about the substantially horizontal axis when the coin to be dropped into the coin sorting opening and sorted is detected based on the detection signal from the sensor and moving the coin supporting section to the retracted position and to push downward the coin which is no longer supported by the coin supporting surface by the coin press section, thereby forcibly dropping it into the coin sorting opening. Therefore, it is possible to reliably drop coins to be sorted into the coin sorting opening and sort them.

In a further preferred aspect of the present invention, the plurality of coin supporting sections are formed on the cylindrical section of the coin sorting member so that in synchronism with the movement of the coin supporting section which has been located at the coin support section thereof and has supported one edge portion of a coin being transported in the coin sorting passage with the coin supporting surface thereof toward the retracted position thereof, the coin press section of the coin supporting section neighboring the coin supporting section moving to the retracted position among the plurality of coin supporting sections can press downward the upper surface of the coin which has been supported by the coin supporting surface of the coin supporting section moving to the retracted position.

According to this preferred aspect of the present invention, the plurality of coin supporting sections are formed on the cylindrical section of the coin sorting member so that in synchronism with the movement of the coin supporting section which has been located at the coin support section thereof and has supported one edge portion of a coin being transported in the coin sorting passage with the coin supporting surface thereof toward the retracted position thereof, the coin press section of the coin supporting section neighboring the coin supporting section moving to the retracted position among the plurality of coin supporting sections can press downward the upper surface of the coin which has been supported by the coin supporting surface of the coin supporting section moving to the retracted position. Therefore, when the coin supporting section which has supported one edge portion of the coin being transported in the coin sorting passage is moved to the retracted position, thereby releasing the support of the coin with the coin supporting surface thereof, the upper surface of the coin which is no longer supported by the coin support surface is pressed downward in synchronism with the retraction of the coin supporting section by the coin press section of the coin supporting section neighboring the coin supporting section moving to the retracted position and forcibly dropped in the coin sorting opening. As a result, it is possible to reliably drop coins to be sorted into the coin sorting opening and sort them.

In a further preferred aspect of the present invention, the coin sorting opening is formed and the coin sorting member is provided so that when the coin supporting section of the coin sorting member is located at the coin supporting position, the circumferential surface of the cylindrical section of the coin sorting member is flush with the inner wall of the reference guide rail and that a distance between the circumferential surface of the cylindrical section and a side portion of the coin sorting opening on the side of the coin sorting passage is smaller than a diameter of the smallest coin to be handled.

According to this preferred aspect of the present invention, since the coin sorting opening is formed and the coin sorting member is provided so that when the coin supporting section of the coin sorting member is located at the coin supporting position, the circumferential surface of the cylindrical section of the coin sorting member is flush with the inner wall of the reference guide rail and that a distance between the circumferential surface of the cylindrical section and a side portion of the coin sorting opening on the side of the coin sorting passage is smaller than a diameter of the smallest coin to be handled, the lower limit of the width of the coin sorting opening in the direction perpendicular to the coin transportation direction is not restricted. Therefore, since no restriction is imposed on diameters of coins to be handled, it is possible to sort coins having diameters greatly different from each other in a desired manner.

In a further preferred aspect of the present invention, the coin sorting member driving means is constituted as a pulse motor.

In a further preferred aspect of the present invention, a drum formed with a gear on a circumferential surface thereof is fixed to an output shaft of the pulse motor, a cylindrical engagement member formed with a gear on a circumferential surface thereof is integrally mounted on the coin sorting member, and the gear formed on the circumferential surface of the engagement member and the gear formed on the circumferential surface of the drum are meshed so that a driving force of the pulse motor can be transmitted to the coin sorting member.

In a further preferred aspect of the present invention, the pulse motor is constituted to rotate the coin sorting member in such a manner that the plurality of coin supporting sections are sequentially located at the coin supporting position.

According to this preferred aspect of the present invention, since the pulse motor is constituted to rotate the coin sorting member in such a manner that the plurality of coin supporting sections are sequentially located at the coin supporting position, even if coins to be sorted are successively fed, it is still possible to reliably drop the coins in the coin sorting opening and sort them.

The above and other objects and features of the present invention will become apparent from the following description made with reference to the accompanying drawings.

DESCRIPTION OF THE PREFERRED EMBODIMENT

Figure 1:
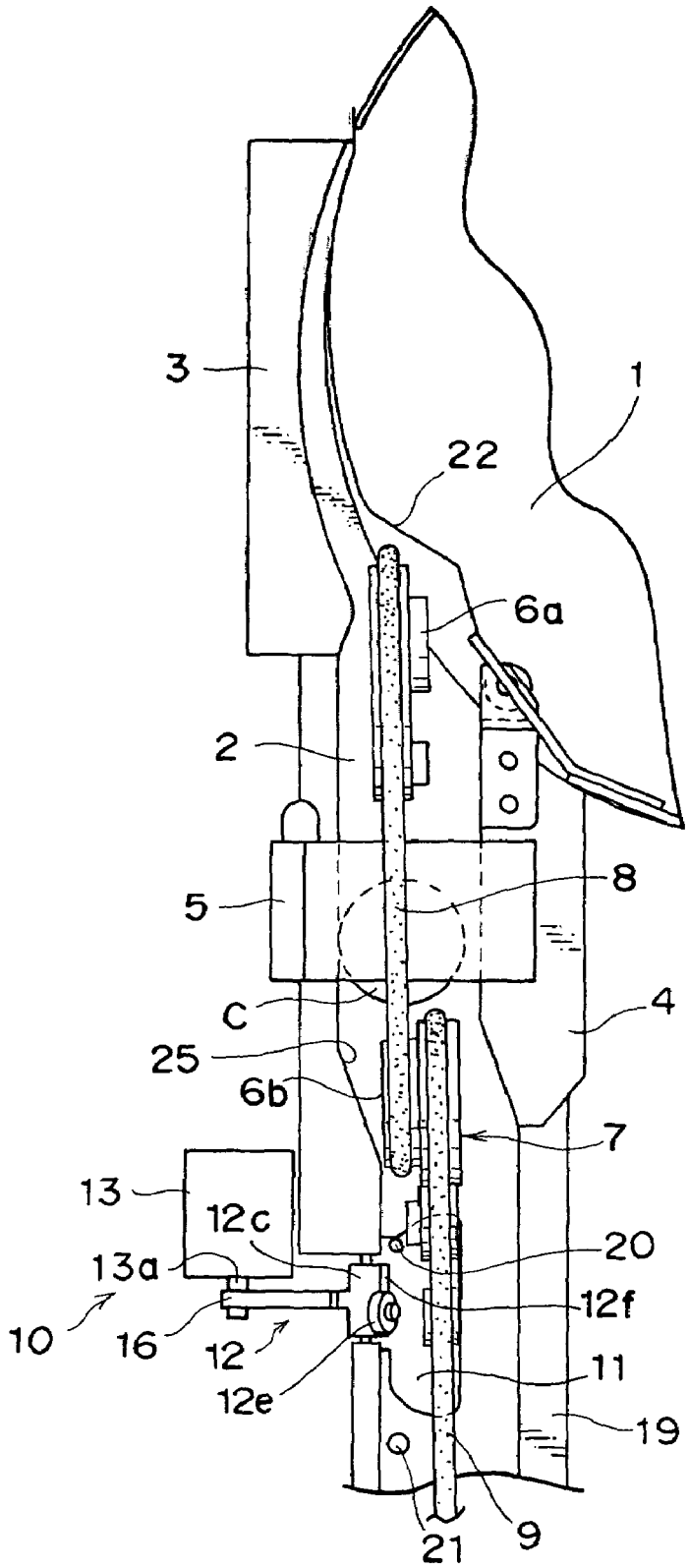
FIG. 1 is a schematic plan view showing a coin sorting passage of a coin handling machine which is a preferred embodiment of the present invention.
Figure 2:
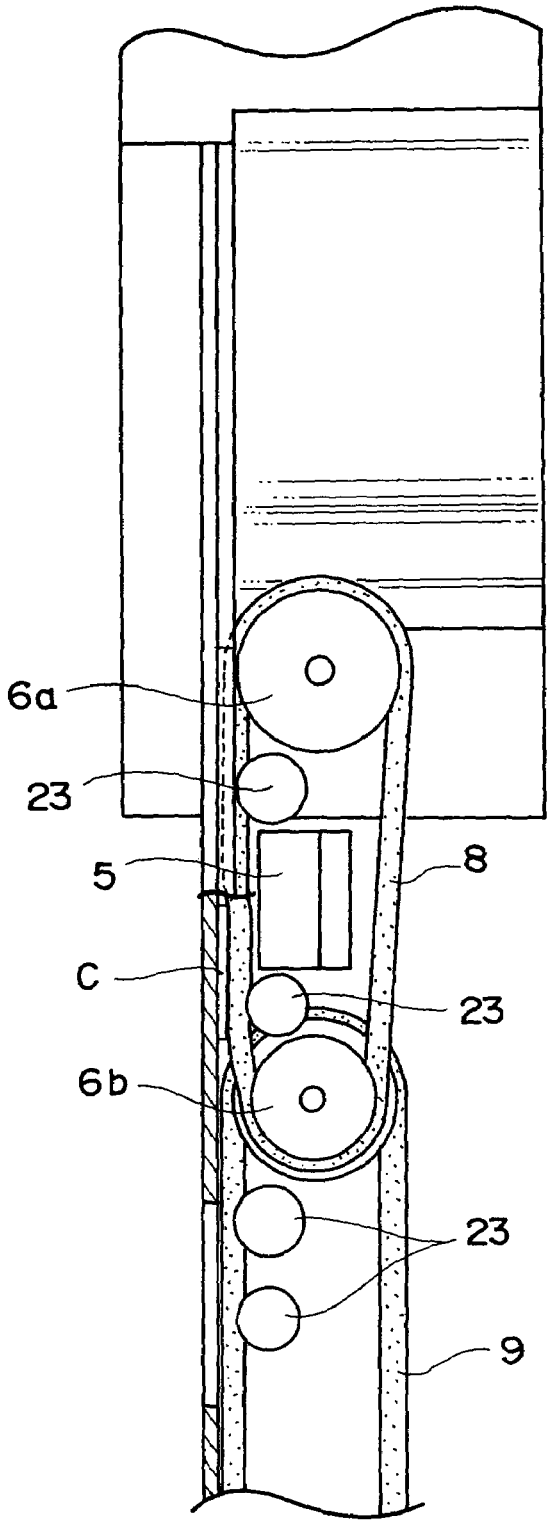
FIG. 2 is a schematic left side view of FIG. 1.

FIG. 1 is a schematic plan view showing a coin sorting passage of a coin handling machine which is a preferred embodiment of the present invention and FIG. 2 is a schematic left side view of FIG. 1.

In this embodiment, a coin handling machine is constituted so as to wrap coins of a denomination specified by an operator.

As shown in FIG. 1, the coin handling machine according to this embodiment includes a rotatable disk 1 for receiving coins C deposited into the coin handling machine via a coin transporting means (not shown) onto the surface thereof and a coin sorting passage 2 connected to the rotatable disk 1.

The coin sorting passage 2 is provided with a reference guide rail 3 for guiding coins C along the inner surface thereof and a guide rail 4 provided to face the reference guide rail 3, and a sensor 5 is provided in the vicinity of the junction between the rotatable disk 1 and the coin sorting passage 2 for optically detecting diameters of coins and magnetically detecting materials of coins.

Further, the coin sorting passage 2 is provided with a first transporting belt 8 wound around a pulley 6*a* and a pulley 6*b* and adapted for conveying coins C while it presses them onto the upper surface of the coin sorting passage 2 and a second transporting belt 9 wound around a pulley 7 and another pulley (not shown) and adapted for conveying coins C at a higher speed than that of the first transporting belt 8 while it presses them onto the upper surface of the coin sorting passage 2, and a coin sorting device 10 is provided in the coin sorting passage 2 below the second transporting belt 9.

Figure 3:
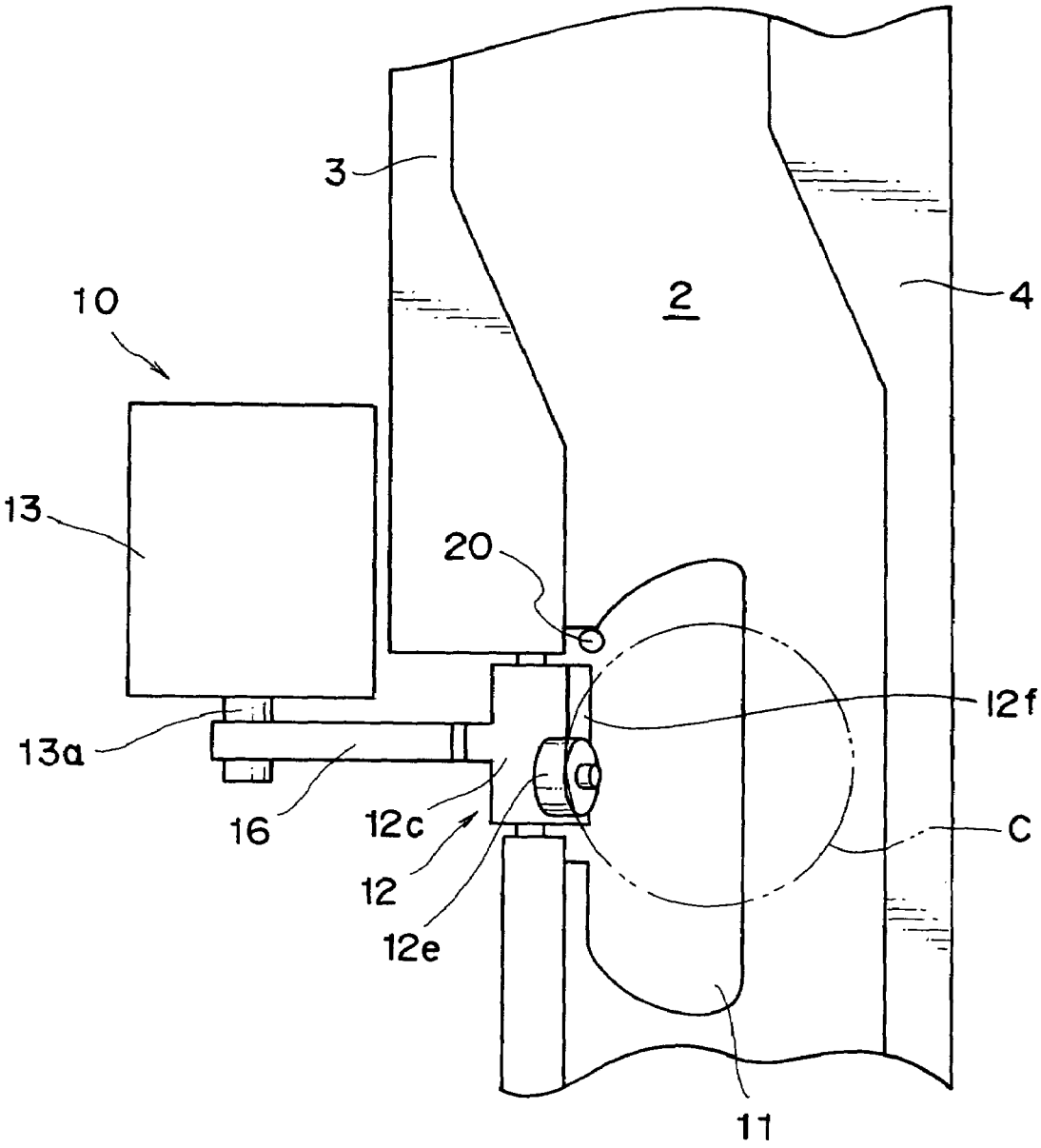
FIG. 3 is a schematic plan view showing a coin sorting device of a coin handling machine which is a preferred embodiment of the present invention.

FIG. 3 is a schematic plan view showing the coin sorting device of the coin handling machine which is a preferred embodiment of the present invention.

As shown in FIG. 3, the coin sorting device 10 includes a coin sorting opening 11 formed in the coin sorting passage 2 along the inner surface of the reference guide rail 3, a coin sorting member 12 provided in the vicinity of the side portion of the coin sorting opening on the side of the reference guide rail 3, a rotary solenoid 13, and an arm 16 one end portion of which is fixed to the output shaft 13*a* of the rotary solenoid 13.

Figure 4:
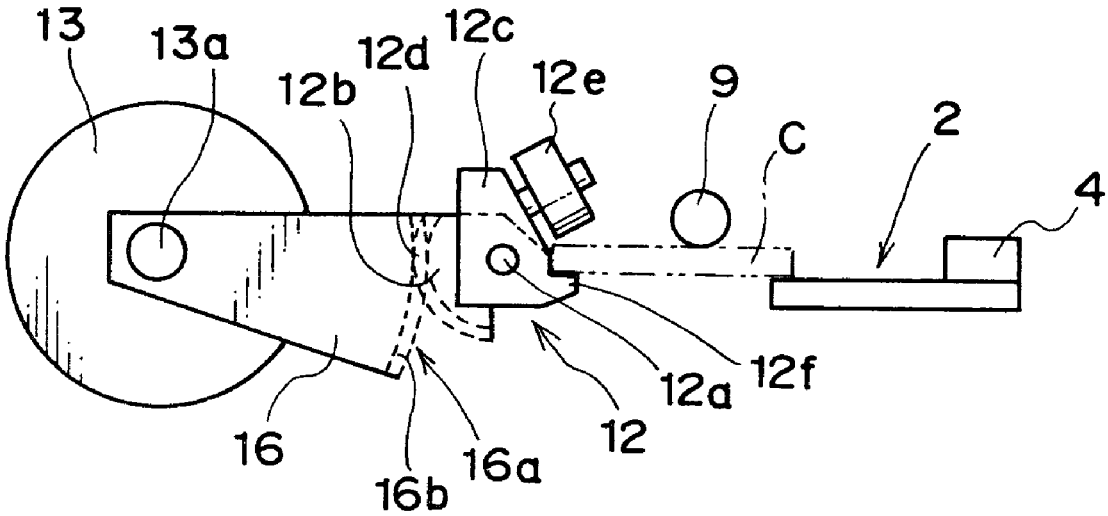
FIG. 4 is a schematic side view of a coin sorting device.

FIG. 4 is a schematic side view of the coin sorting device 10.

As shown in FIG. 4, the tip end portion 16*a* of the arm 16 has a fan-like side cross section and the tip end portion 16*a* of the arm is formed with a gear 16*b*.

As shown in FIG. 4, the coin sorting member 12 is rotatably mounted on a horizontal shaft 12*a* and includes an engagement portion 12*b* having a fan-like side cross section and formed with a gear 12*d* meshing with the gear 16*b* formed at the tip end portion 16*a* of the arm 16.

The coin sorting member 12 includes a coin supporting member 12*c* having a coin supporting portion 12*f* for supporting the edge portion of a coin C being transported in the coin sorting passage 2 and the coin supporting portion 12*f* of the coin supporting member 12*c* is constituted so as to be rotatable about the horizontal shaft 12*a* between a coin support position where the edge portion of a coin C is supported by the coin supporting portion 12*f* of the coin supporting member 12*c* and a retracted position where the coin supporting portion 12*f* is retracted from the coin support position and the coin C is dropped in the coin sorting opening 11.

In this embodiment, the coin sorting opening 11 is formed so that when the coin sorting member 12 is located at the coin support position, the distance between the end portion of the coin sorting opening on the side of the guide rail 4 and the inner surface of the coin supporting portion 12*f* of the coin supporting member 12*c* on the side of the reference guide rail 3 is slightly smaller than the diameter of the smallest coin to be handled and the coin sorting member 12 is disposed so that when the coin sorting member 12 is located at the coin support position, the side wall of the coin supporting portion 12*f* of the coin supporting member 12*c* is flush with the guide surface of the reference guide rail 3 and the upper surface of the coin supporting portion 12*f* of the coin supporting member 12*c* is located with in a plane where the upper surface of the coin sorting passage 2 is located.

As shown in FIG. 4, a coin press member 12*e* is integrally mounted on the coin supporting member 12*c* of the coin sorting member 12.

Figure 5:
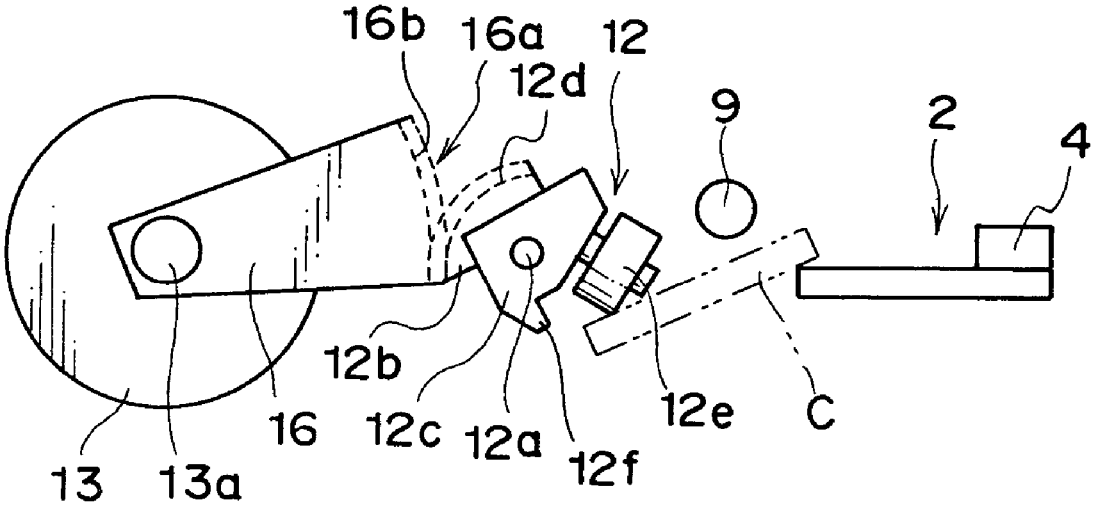
FIG. 5 is a schematic side view of a coin sorting member located at its retracted position.

FIG. 5 is a schematic side view of the coin sorting member 12 located at its retracted position.

As shown in FIG. 5, when the rotary solenoid 13 is driven, the output shaft 13*a* of the rotary solenoid 13 is rotated counterclockwise in FIGS. 4 and 5 and the arm 16 is rotated counterclockwise.

As a result, a rotational force of the output shaft 13*a* of the rotary solenoid 13 is transmitted by the gear 16*b* formed at the tip end portion 16*a* of the arm 16 and the gear 12*d* of the engagement portion 12*b* meshing therewith to the coin sorting member 12, whereby the coin sorting member 12 is rotated about the horizontal shaft 12*a* clockwise in FIGS. 4 and 5.

Therefore, if the rotary solenoid 13 is driven to move the coin supporting member 12*c* to its retracted position when the edge portion of a coin C to be sorted is being supported by the coin supporting portion 12*f* of the coin supporting member 12*c* constituting the coin sorting member 12, the edge portion of the coin C becomes no longer supported by the coin supporting portion 12*f* of the coin supporting member 12*c* and the coin is pushed downward by the coin press member 12*e* integrally mounted on the coin supporting member 12*c*, whereby the coin C is forcibly dropped in the coin sorting opening 11 and the coin C can be sorted in a desired manner.

As shown in FIGS. 1 and 3, a coin sensor 20 is provided for detecting the passage of coins C in the coin sorting passage 2 immediately upstream of the coin sorting opening 11 and a sensor 21 is provided for counting the number of coin C passing thereover in the coin sorting passage 2 immediately downstream of the coin sorting opening 11.

The pulley 6*b* around which the first transporting belt 8 is wound and the pulley 7 around which the second transporting belt 9 is wound are integrally formed and they are formed so that the diameter of the pulley 6*b* is smaller than that of the pulley 7. Since the drive speed of the second transporting belt 9 is therefore higher than that of the first transporting belt 8, the conveying speed of a coin C is accelerated by the second transporting belt 9 and the distance between coins successively fed in the coin sorting passage 2 is broadened, thereby reliably sorting coins C.

In FIG. 1, the reference numeral 22 designates a clearance setting member adapted for setting a clearance between itself and the surface of the rotatable disk 1 in accordance with the thickness of coins C to be handled in order to prevent two or more coins C from being simultaneously fed out from the rotatable disk 1 to the coin sorting passage 2, and in FIG. 2, the reference numeral 23 designates press rollers for pressing the first transporting belt 8 and the second transporting belt 9 toward the surface of the coin sorting passage 2.

Figure 6:
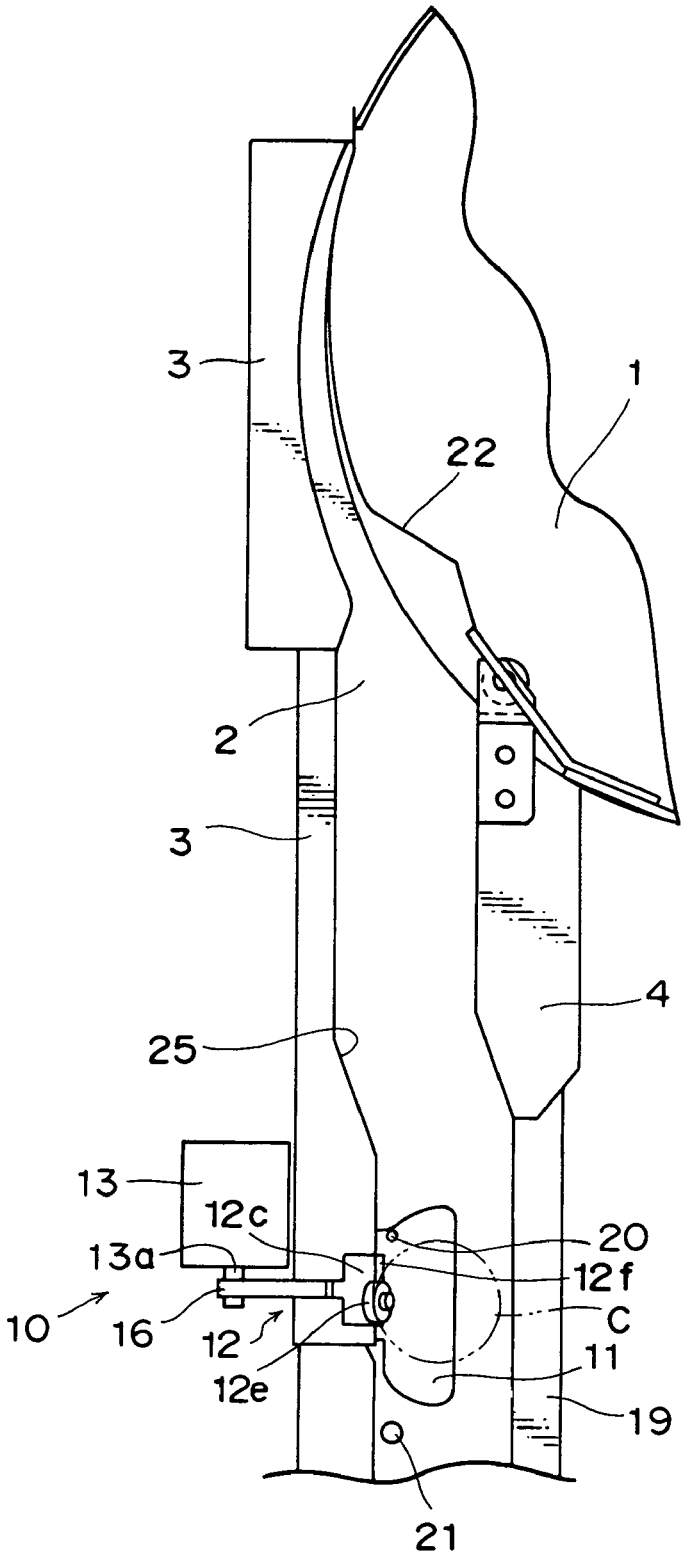
FIG. 6 is a schematic plan view of a coin handling machine from which a first transporting belt and a second transporting belt are removed.

FIG. 6 is a schematic plan view of the coin handling machine from which the first transporting belt 8 and the second transporting belt 9 are removed.

As shown in FIG. 6, the reference guide rail 3 includes a slant wall portion 25 formed so that the side surface thereof is at an angle with the longitudinal direction of the first transporting belt 8 in order that a coin C can be reliably guided along the inner surface of the reference guide rail 3 on the side of the coin sorting passage 2, and the guide rail 4 also includes a slant wall portion formed so that the inner surface thereof is at an angle with the longitudinal direction of the first transporting belt 8 in order that the distance between itself and the reference guide rail 3 can be maintained constant.

Although not shown in Figures, a coin stacking section including a pair of stacking drums and adapted for stacking a predetermined number of coins C therein is provided at the downstream end portion of the coin sorting passage 2 and a coin wrapping section including a plurality of wrapping rollers and adapted for wrapping a predetermined number of the coins C stacked in the coin stacking section is provided below the coin stacking section.

Figure 7:
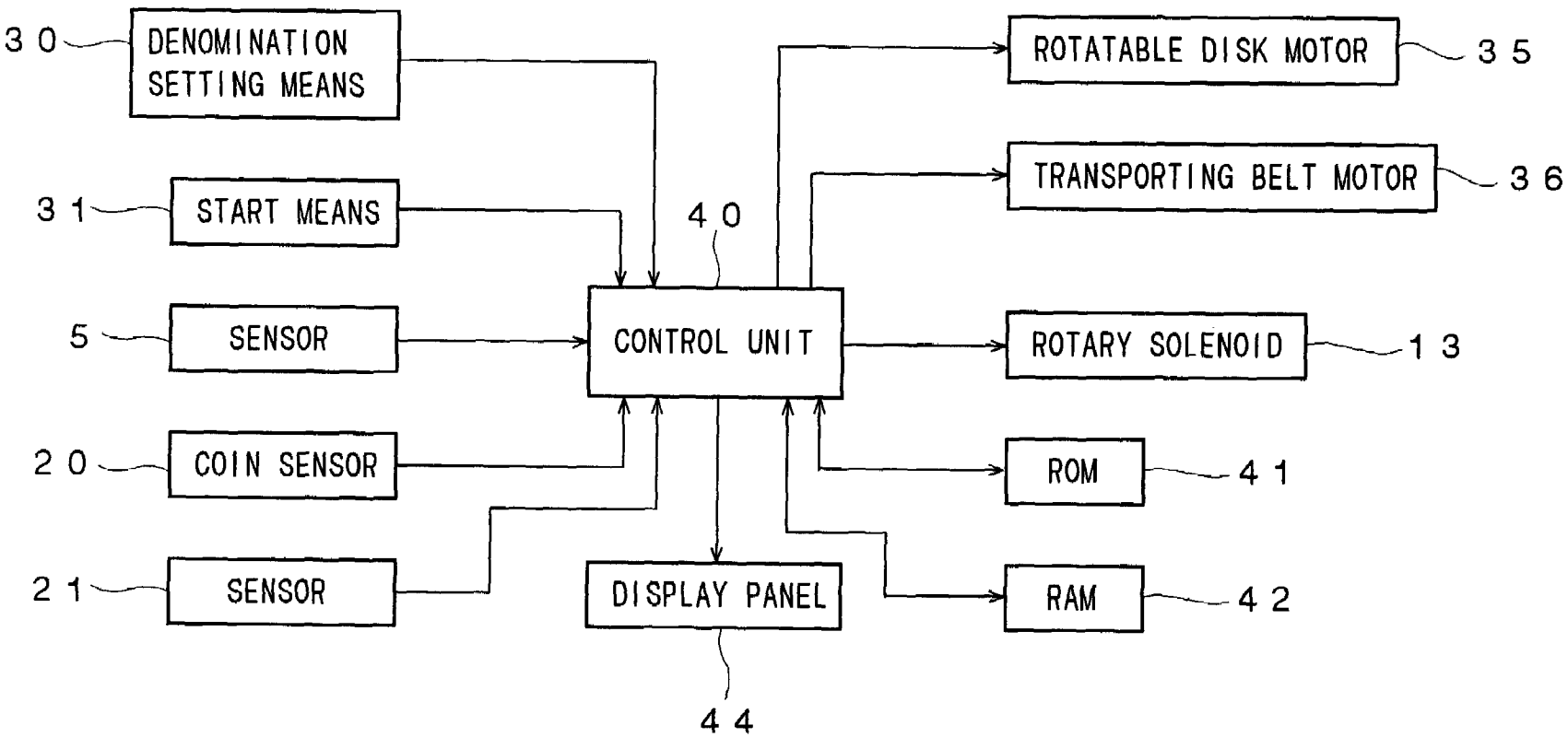
FIG. 7 is a block diagram of an input system, a detection system, a driving system, a control system and a display system of a coin handling machine which is a preferred embodiment of the present invention.

FIG. 7 is a block diagram of an input system, a detection system, a driving system, a control system and a display system of a coin handling machine which is a preferred embodiment of the present invention.

As shown in FIG. 7, the input system of the coin handling machine according to this embodiment includes a denomination setting means 30 through which a denomination of coins to be wrapped is input and a start means 31 for starting the coin handling operation. The detection system of the coin handling machine includes the sensor 5 for optically detecting diameters, colors and surface patterns of coins C and magnetically detecting materials of coins C, the coin sensor 20 for detecting the presence of coins C and the sensor 21 for counting the number of coins C passing thereover.

As shown in FIG. 7, the driving system of the coin handling machine according to this embodiment includes a rotatable disk motor 35 for rotating the rotatable disk 1, a transporting belt motor 36 for driving the first transporting belt 8 and the second transporting belt 9, and the rotary solenoid 13 for rotating the coin sorting member 12 via the arm 16.

As also shown in FIG. 7, the control system of the coin handling machine according to this embodiment includes a control unit 40 for controlling the overall operation of the coin handling machine, a ROM 41 for storing an operation program for the coin handling machine, reference optical data regarding diameters, colors and surface patterns of coins C for each denomination and reference magnetic data regarding magnetic properties of coins C for each denomination, and a RAM 42 for storing various data. The display system of the coin handling machine includes a display panel 44 for displaying the results of coin handling and the like.

The thus constituted coin handling machine according to a preferred embodiment of the present invention sorts and collects coins C of a denominations other than that specified and wraps coins of the specified denomination.

When the handling operation of coins C is to be started, the denomination setting means 30 is first operated by the operator, thereby specifying the denomination of coins C to be wrapped and the start means 31 is then operated.

When the denomination of coins C to be wrapped is input by the operator, a denomination setting signal is output from the denomination setting means 30 to the control unit 40.

When the denomination setting signal is input from the denomination setting means 30, the control unit 40 reads the optical reference data regarding the diameter, color and surface pattern of the coin C of the denomination to be wrapped and the reference magnetic data regarding the magnetic property thereof from the ROM 41 based on the thus input denomination setting signal and stores them in the RAM 42.

When a start signal is input from the start means 31, the control unit 40 outputs drive signals to the rotatable disk motor 35 and the transporting belt motor 36, thereby causing the rotatable disk motor 35 to rotate the rotatable disk 1 and causing the transporting belt motor 36 to drive the first transporting belt 8 and the second transporting belt 9.

Coins are then deposited by the operator into a coin depositing section (not shown).

The coins C deposited into the coin handling machine through the coin depositing section are fed by a coin transporting means (not shown) onto the rotatable disk 1 and fed into the coin sorting passage 2 by centrifugal force produced by the rotation of the rotatable disk 1. At this time, the clearance setting member 22 prevents two coins C from being simultaneously fed and the coins C are fed into the coin sorting passage 2 one by one.

The diameter, color, surface pattern and the magnetic property of the coin fed into the coin sorting passage 2 are detected by the sensor 5 and detection signals are output from the sensor 5 to the control unit 40.

Based on the detection signals input from the sensor 5, the control unit 40 compares detected optical data regarding the diameter, color and surface pattern of the coin C and detected magnetic data regarding the magnetic property of the coin C with the reference optical data and the reference magnetic data stored in the RAM 42.

As a result, when the control unit 40 judges that the detected optical data regarding the diameter, color and surface pattern of the coin C and the reference optical data substantially coincide with each other and that the detected magnetic data regarding the magnetic property of the coin C and the reference magnetic data substantially coincide with each other, it judges that the coin C is one of the denomination specified by the denomination setting means 30 as that to be wrapped and writes data indicating the result of judgment in the RAM 42.

To the contrary, when the control unit 40 judges that the coin C is not of the denomination specified by the denomination setting means 30 as that to be wrapped, it writes data indicating the result of judgment in the RAM 42.

When the coin C is further fed by the first transporting belt 8 and the second transporting belt 9 along the reference guide rail 3 in the coin sorting passage 2 and the coin sensor 20 detects the coin C, a coin detection signal is output from the coin sensor 20 to the control unit 40.

When the control unit 40 receives the coin detection signal from the coin sensor 20, it accesses the RAM 42 and judges whether or not the coin C is one of the denomination to be wrapped. When the control unit 40 judges that the coin C is one of the denomination to be wrapped, it outputs no signal.

Therefore, after the coin sensor 20 detects the coin C of the denomination to be wrapped, the coin C is transported in the coin sorting passage 2 along the reference guide rail 3 and the side wall of the coin supporting portion 12*f* of the coin supporting member 12*c* constituting the coin sorting member 12 and being disposed to be flush with the guide surface of the reference guide rail 3 and the coin C to be sorted is transported in the coin sorting passage 2 and passes through the coin sorting opening 11, while one edge portion thereof is being supported by the coin supporting portion 12*f* of the coin supporting member 12*c* constituting the coin sorting member 12 located at its coin support position and the other edge portion thereof is being supported by the upper surface of the coin sorting passage 2 as shown in FIG. 4.

To the contrary, when the control unit 40 judges based on data stored in the RAM 42 that the coin C is of a denomination other than that to be wrapped, namely, the coin C is a genuine coin C of a denomination other than that to be wrapped or an unacceptable coin C such a counterfeit coin, a foreign coin or the like, the control unit 40 outputs a drive signal to the rotary solenoid when the coin C passes through the coin sensor.

When the drive signal is output from the control unit 40 to the rotary solenoid 13, the rotary solenoid 13 is driven so that the output shaft 13*a* of the rotary solenoid 13 is rotated counterclockwise in FIGS. 4 and 5.

As a result, the arm 16 is swung counterclockwise in FIGS. 4 and 5 about the output shaft 13*a* of the rotary solenoid 13 and the rotational force of the output shaft 13*a* of the rotary solenoid 13 is transmitted by the gear formed at the tip end portion 16*a* of the arm 16 and the gear of the engagement portion 12*b* meshing therewith to the coin sorting member 12, whereby the coin sorting member 12 is rotated clockwise in FIGS. 4 and 5 about the horizontal shaft 12*a*.

Therefore, after the coin sensor detects the genuine coin C of the denomination other than that to be wrapped or the unacceptable coin C such as a counterfeit coin, a foreign coin or the like, the coin C is transported in the coin sorting passage 2 along the reference guide rail 3 and the side wall of the coin supporting portion 12*f* of the coin supporting member 12*c* constituting the coin sorting member 12 and being disposed to be flush with the guide surface of the reference guide rail 3. As a result, one edge portion of the coin C is supported by the coin supporting portion 12*f* of the coin supporting member 12*c* constituting the coin sorting member 12 located at its coin support position and the other edge portion thereof is supported by the upper surface of the coin sorting passage 2 as shown in FIG. 4. However, since the coin sorting member 12 is rotated clockwise in FIGS. 4 and 5 about the horizontal shaft 12*a* when the coin C passes through the coin sensor 20 and the coin supporting member 12*c* is moved to the retracted position thereof as shown in FIG. 5, the one edge portion of the coin C becomes no longer supported by the coin supporting portion 12*f* of the coin supporting member 12*c*. Further, since the coin press member 12*e* integrally mounted on the coin supporting member 12*c* is rotated clockwise in FIGS. 4 and 5 about the horizontal shaft 12*a*, the coin C is pressed downward by the coin press member 12*e* and forcibly dropped in the coin sorting opening 11 to be sorted and collected in a coin collecting box (not shown).

As described above, in this embodiment, a genuine coin C of a denomination other than that to be wrapped or an unacceptable coin C such as a counterfeit coin, a foreign coin or the like is forcibly dropped into the coin sorting opening 11 and sorted by rotating the coin supporting member 12*c* and the coin press member 12*e* integrally mounted thereon clockwise in FIGS. 4 and 5 about the horizontal shaft 12*a* and moving the coin supporting member 12*c* of the coin sorting member 12. Therefore, even if the coin C preceding the coin C to be dropped into the coin sorting opening 11 and sorted or the coin C following the coin C to be dropped into the coin sorting opening 11 and sorted is being transported with a short interval between itself and the coin to be sorted, it is possible to reliably drop only the coin to be sorted into the coin sorting opening 11, thereby sorting it. Further, since the first transporting belt 8 and the second transporting belt 9 are not moved by the coin sorting member 12 in the widthwise direction of the coin sorting passage 2 and, therefore, the preceding coin C or the following coin C is not dropped into the coin sorting opening 11 by the first transporting belt 8 and the second transporting belt 9, it is possible to reliably drop only the coin to be sorted into the coin sorting opening 11, thereby sorting it.

When a predetermined time period has passed after the rotary solenoid 13 was driven, the control unit 40 outputs a drive stop signal to the rotary solenoid 13.

As a result, the output shaft 13*a* of the rotary solenoid 13 is returned to the original rotation position so that the arm 16 is swung clockwise in FIGS. 4 and 5 about the output shaft 13*a* of the rotary solenoid 13 and the coin sorting member 12 is rotated counterclockwise in FIGS. 4 and 5 about the horizontal shaft 12*a*. Thus, the coin supporting member 12 is returned to its coin support position.

To the contrary, coins C to be wrapped and passing through the coin sorting device 10 pass over the sensor 21, whereby the number thereof is counted and fed to the coin stacking section (not shown) connected to the downstream end portion of the coin sorting passage 2 to be stacked therein.

Every time the sensor 21 detects a coin C, a coin detection signal is output from the sensor 21 to the control unit 40. The control unit 40 counts the number of coins C to be wrapped and passing through the sensor 21 based on the coin detection signals input from the sensor 21 and writes the counted value in the RAM 42. Based on the counted value of the coins C to be wrapped written in the RAM 42, when the control unit 40 judges that a predetermined number of coins C to be wrapped have been fed to the coin stacking section, it projects a stopper (not shown) into the coin sorting passage 2, thereby preventing following coins from being fed to the coin stacking section.

A predetermined number of coins C fed to the coin stacking section and stacked therein are fed to the coin wrapping section (not shown) and a wrapping paper is wound by a plurality of wrapping rollers around the stacked coins C, thereby producing a wrapped coin roll.

On the other hand, every time the coin sensor 20 detects a coin C of a denomination other than that to be wrapped, the control unit 40 outputs a drive signal to the rotary solenoid 13 for a predetermined time period and causes it to rotate the coin sorting member 12 about the horizontal shaft 12*a*, thereby moving the coin supporting member 12*c* to its retracted position. As a result, all coins C having denominations other than that to be wrapped are dropped by the coin sorting device 10 into the coin sorting opening 11 to be sorted and collected in a coin collecting box (not shown).

Thus, when all coins to be wrapped have been fed to the coin stacking section in a predetermined number and wrapped in the coin wrapping section, and all coins C of denominations other than that of the coin C to be wrapped have been sorted by the coin sorting device 10, dropped into the coin sorting opening 11 and collected in the coin collecting box (not shown), the handling operation of coins C of the coin handling machine is completed.

According to the above described embodiment, one edge portion of the coin C to be dropped into the coin sorting opening 11 and sorted is supported by the coin supporting portion 12*f* of the coin supporting member 12*c* constituting the coin sorting member 12 and the other edge portion thereof is supported by the upper surface of the coin sorting passage 2. Then, the rotary solenoid 13 is driven, whereby the arm 16 is swung counterclockwise in FIGS. 4 and 5 about the output shaft 13*a* of the rotary solenoid 13 and the coin supporting member 12*c* and the coin press member 12*e* integrally mounted thereon are rotated clockwise in FIGS. 4 and 5 about the horizontal shaft 12*a* and the coin supporting member 12*c* of the coin sorting member 12 is moved to the retracted position thereof. As a result, since the one edge portion of the coin C becomes no longer supported by the coin supporting portion 12*f* of the coin supporting member 12*c* and the coin C to be sorted is further pressed downward by the coin press member 12*e* integrally mounted on the coin supporting member 12*c* of the coin sorting member 12, thereby being forcibly dropped into the coin sorting opening 11, it is possible to reliably drop coins C to be sorted into the coin sorting opening and sort them.

Further, according to the above described embodiment, since a coin C to be sorted is forcibly dropped into the coin sorting opening 11 by rotating the coin supporting member 12*c* and the coin press member 12*e* integrally mounted thereon clockwise in FIGS. 4 and 5 about the horizontal shaft 12*a* and moving the coin supporting member 12*c* to its retracted position and is sorted, even if the coin C preceding the coin C to be dropped into the coin sorting opening 11 and sorted or the coin C following the coin C to be dropped into the coin sorting opening 11 and sorted is being transported with a short interval between itself and the coin C to be sorted, it is still possible to reliably drop only the coin C to be sorted into the coin sorting opening 11, thereby sorting it. Further, since the first transporting belt 8 and the second transporting belt 9 are not moved by the coin sorting member 12 in the widthwise direction of the coin sorting passage 2 and, therefore, the preceding coin C or the following coin C is not dropped by the first transporting belt 8 and the second transporting belt 9 into the coin sorting opening 11, it is possible to reliably drop only the coin C to be sorted into the coin sorting opening 11, thereby sorting it.

Moreover, according to the above described embodiment, since a coin C to be sorted is pressed downward by the coin press member 12*e* integrally mounted on the coin supporting member 12*c* and forcibly dropped into the coin sorting opening 11, it is possible to reliably drop the coin C to be sorted in the coin sorting opening 11 and sort it without making the coin sorting passage 2 considerably long. Therefore, even when the transporting speed of coins is increased in order to improve the handling efficiency of the coins C, the coin handling machine can still be made markedly small because it is unnecessary to lengthen the coin sorting passage 2.

Further, according to the above described embodiment, since it is sufficient to form the coin sorting opening 11 so that the width thereof in a direction perpendicular to the coin transportation direction is smaller than the diameter of the smallest coin to be handled, the lower limit value of the diameter of the coin sorting opening 11 is not restricted. Therefore, since no restriction is imposed on diameters of coins to be handled, it is possible to sort coins having diameters greatly different from each other in accordance with their denominations in a desired manner.

Figure 8:
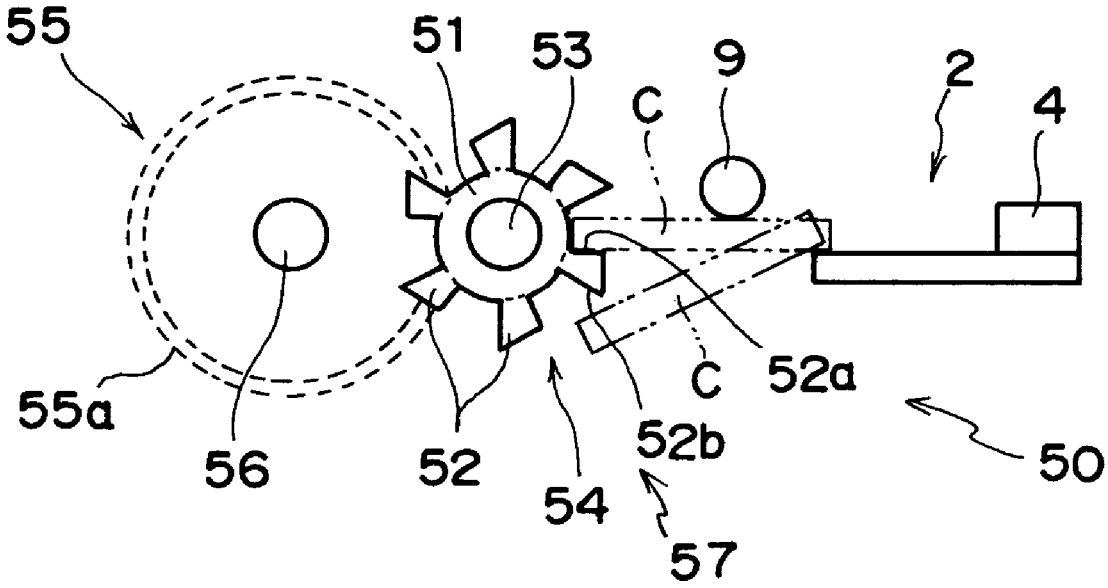
FIG. 8 is a schematic side view showing a coin sorting device of a coin handling machine which is another preferred embodiment of the present invention.

FIG. 8 is a schematic side view showing a coin sorting device of a coin handling machine which is another preferred embodiment of the present invention.

The coin handling machine according to this embodiment is constituted so as to sort unacceptable coins C such as a counterfeit coin, a foreign coin or the like and coins damaged to higher than a predetermined level from among coins deposited into the coin handling machine and separately collect them.

As shown in FIG. 8, instead of being provided with the coin sorting member 12 that includes the coin supporting member 12*c* having the coin press member 12*e* integrally mounted thereon and is rotatable about the horizontal shaft 12*a*, the coin handling machine according to this embodiment is provided with a cylindrical coin sorting member 54 that includes a cylindrical section 51 and six coin supporting sections 52 radially extending from the cylindrical section 51 and is rotatable about a horizontal shaft 53.

Although not shown in FIG. 8, a cylindrical engagement member formed with a gear on the circumference thereof is integrally mounted on the horizontal shaft 53 of the coin sorting member 54 and the gear formed on the circumference of the engagement member meshes with a gear 55*a* formed on the circumferential surface of a drum 55.

The coin sorting device 50 further includes a pulse motor (not shown) and the drum 55 is fixed to the output shaft 56 of the pulse motor and is constituted so as to be intermittently rotated counterclockwise in FIG. 8 about the output shaft 56 by the pulse motor.

Therefore, the rotational force of the pulse motor is transmitted to the coin sorting member 54 via the gear 55*a* formed on circumferential surface of a drum 55 and the gear formed on the circumference of the engagement member and the coin sorting member 54 is intermittently rotated clockwise in FIG. 8 about the horizontal shaft 53.

As shown in FIG. 8, each of the coin supporting sections 52 includes a coin supporting surface 52*a* for supporting a coin C on the surface thereof and a coin press section 52*b* for pressing the upper surface of a coin C and forcibly dropping it into the coin sorting opening 57.

As shown in FIG. 8, the coin sorting member 54 is normally positioned so that the coin supporting surface 52*a* of one of the six coin supporting sections 52 is located in the same plane as that of the upper surface of the coin sorting passage 2, namely, at a coin support position where it can support one edge portion of a coin C and when a coin C is to be dropped in the coin sorting opening 57 and sorted, the coin sorting member 54 is intermittently rotated by the pulse motor until the coin supporting surface 52*a* of the coin supporting section 52 to be next located at the coin support position is located in the same plane as that of the upper surface of the coin sorting passage 2. Therefore, by intermittently rotating the coin sorting member 54, one edge portion of a coin C which has been supported by the coin support surface 52*a* of one of the coin supporting section 52 of the coin sorting member 54 becomes no longer supported thereby and the upper surface of the coin C is pressed by the coin press section 52*b* of the coin supporting section 52 to be next located at the coin support position, whereby the coin C is forcibly dropped into the coin sorting opening 57 and sorted.

The coin sorting member 54 is disposed so that the circumferential surface of the cylindrical section 51 is flush with the guide surface of the reference guide rail 3 when the coin supporting surface 52*a* of one of the six coin supporting sections 52 is held in the same plane as that of the upper surface of the coin sorting passage 2.

Figure 9:
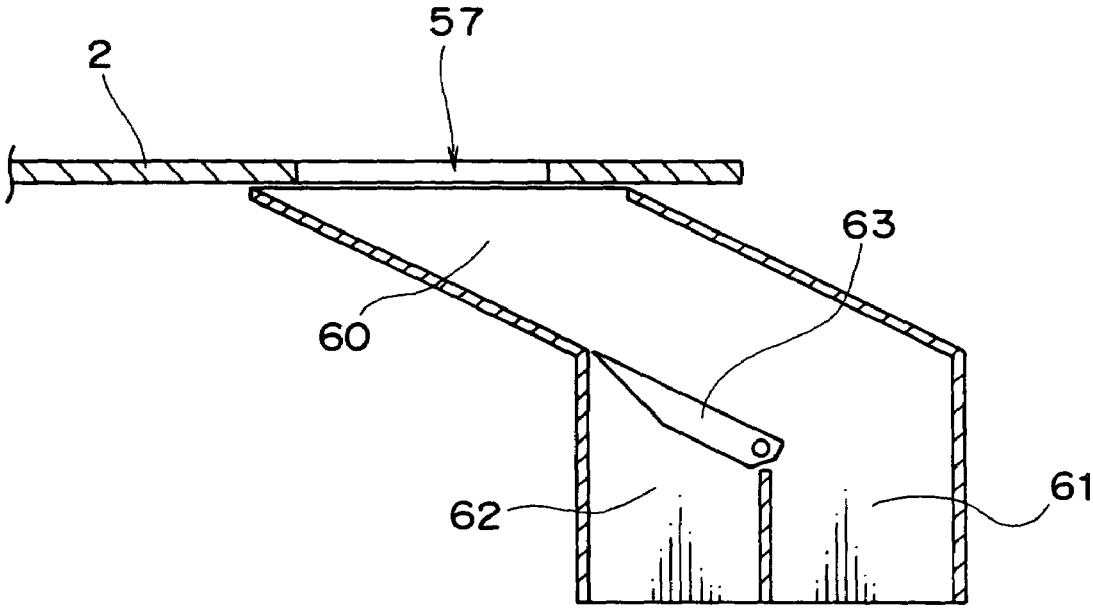
FIG. 9 is a schematic longitudinal cross sectional view of a coin sorting opening.
Figure 10:
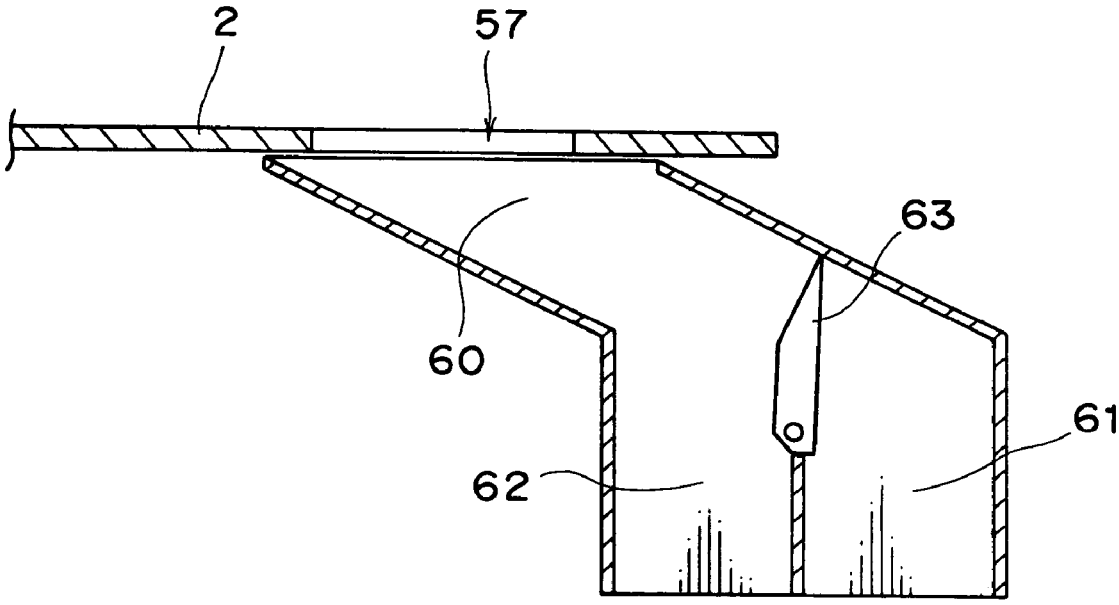
FIG. 10 is a schematic longitudinal cross sectional view of a coin sorting opening.

FIGS. 9 and 10 are schematic longitudinal cross sectional views of the coin sorting opening 57.

As shown in FIGS. 9 and 10, a coin collecting passage 60 extending obliquely downward with respect to the transportation direction of coins C is connected to the coin sorting opening 57 and the coin collecting passage 60 is bifurcated into a damaged coin collecting passage 61 for collecting a coin damaged to higher than a predetermined level and an unacceptable coin collecting passage 62 for collecting an unacceptable coin such as a counterfeit coin, a foreign coin or the like. A gate 63 is provided at the bifurcating portion.

The lower end portion of the damaged coin collecting passage 61 is connected to a damaged coin collecting box (not shown) and the lower end portion of the unacceptable coin collecting passage 62 is connected to an unacceptable coin collecting ox (not shown).

The gate 63 is constituted so as to be swingable by a gate solenoid (not shown) about the upper end portion of a wall portion separating the damaged coin collecting passage 61 and the unacceptable coin collecting passage 62 and selectively cause the coin collecting passage 60 to communicate with the damaged coin collecting passage 61 as shown in FIG. 9 or cause the coin collecting passage 60 to communicate with the unacceptable coin collecting passage 62 as shown in FIG. 10. When no drive signal is output to the gate solenoid, the gate 63 is held at a position shown in FIG. 9 and the coin collecting passage 60 communicates with the damaged coin collecting passage 61.

Figure 11:
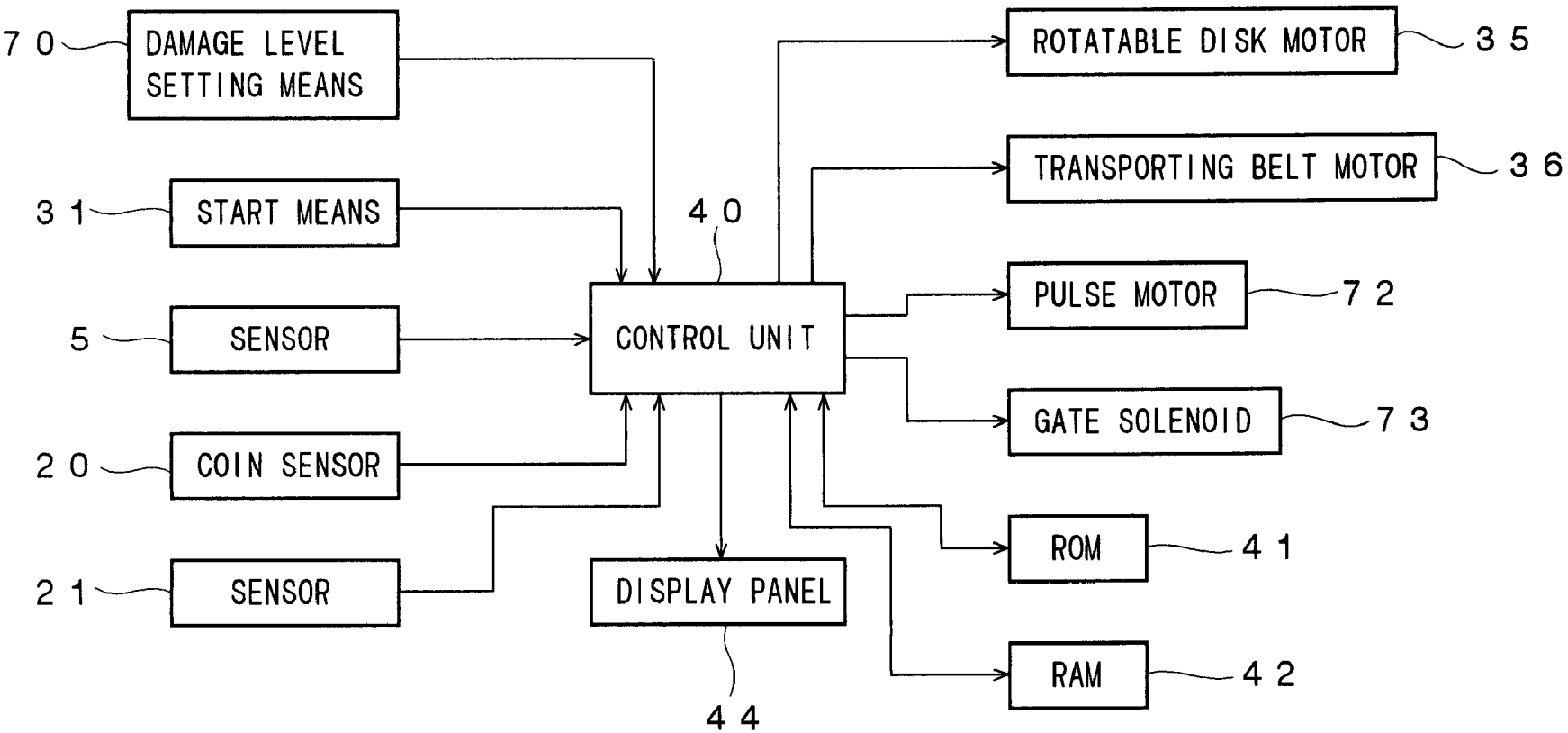
FIG. 11 is a block diagram of an input system, a detection system, a driving system, a control system and a display system of a coin handling machine which is another preferred embodiment of the present invention.

FIG. 11 is a block diagram of an input system, a detection system, a driving system, a control system and a display system of a coin handling machine which is another preferred embodiment of the present invention.

As shown in FIG. 11, the input system of the coin handling machine according to this embodiment includes a damage level setting means 70 for setting a damage level of a coin C to be collected and the start means 31 for starting the handling operation of coins C. The detection system of the coin handling machine includes the sensor 5 for optically detecting diameters, colors and surface patterns of coins C and magnetically detecting materials of coins C, the coin sensor 20 for detecting the presence of coins C and the sensor 21 for counting the number of coins C passing thereover.

As shown in FIG. 11, the driving system of the coin handling machine according to this embodiment includes the rotatable disk motor 35 for rotating the rotatable disk 1, the transporting belt motor 36 for driving the first transporting belt 8 and the second transporting belt 9, the pulse motor 72 for intermittently rotating the coin sorting member 54 via the drum 55, and a gate solenoid 73 for swinging the gate 63.

As shown in FIG. 11, the control system of the coin handling machine according to this embodiment includes the control unit 40 for controlling the overall operation of the coin handling machine, the ROM 41 for storing an operation program for the coin handling machine, reference optical data regarding diameters, colors and surface patterns of coins C for each denomination, reference magnetic data regarding magnetic properties of coins C for each denomination and reference damage level data regarding diameters, colors and surface patterns of coins C for each denomination, and the RAM 42 for storing various data. The display system of the coin handling machine includes the display panel 44 for displaying the results of coin handling and the like.

The reference damage level data are used for discriminating whether or not the damage level of an acceptable coin C exceeds a predetermined level. When a coin has been in circulation for a long time, since the coin C is abraded, whereby the diameter thereof becomes slightly smaller, the coin C is discolored, whereby the surface reflectivity is lowered or the raised and depressed portions of the surface of the coin C are abraded, whereby the surface pattern changes. The detected optical data regarding the diameter, color and surface pattern of the coin C therefore changes. Since the detected optical data of a coin C which has been in circulation for a long time do not usually coincide with the reference optical data produced based on a coin which has been in circulation for a short time, it is necessary for the ROM 41 to store the reference damage level data for discriminating a coin C which has been in circulation for a long time and damaged, in addition to the reference optical data produced based on a coin which has been in circulation for a short time, in order to discriminate a coin C whose damage level exceeds a predetermined level and collecting the damaged coin separately from unacceptable coins C.

In this embodiment, the operator can operate the damage level setting means 70 to set the damage level of a coin to be collected and, therefore, the ROM 41 stores several kinds of reference damage level data corresponding to damage levels selectable by the operator for each denomination.

The thus constituted coin handling machine detects a coin C whose damage level exceeds a predetermined level and leads it from the coin sorting opening 57 into the damaged coin collecting passage 61 via the coin collecting passage 60, thereby collecting it in the damaged coin collecting box (not shown), or detects an unacceptable coin C and leads it from the coin sorting opening 57 into the unacceptable coin collecting passage 62 via the coin collecting passage 60, thereby collecting it in the unacceptable coin collecting box (not shown) in the following manner.

When the handling operation of coins C is to be started, the damage level setting means 70 is first operated by the operator and the start means 31 is then operated.

When the damage level setting means 70 is operated by the operator and the damage level of coins C to be collected is set, a damage level setting signal is output from the damage level setting means 70 to the control unit 40.

When the control unit 40 receives the damage level setting signal, it writes the damage level of coins C to be collected in the RAM 42 based on the damage level setting signal.

When a start signal is input from the start means 31, the control unit 40 outputs drive signals to the rotatable disk motor 35 and the transporting belt motor 36, thereby causing the rotatable disk motor 35 to rotate the rotatable disk 1 and causing the transporting belt motor 36 to drive the first transporting belt 8 and the second transporting belt 9.

Coins are then deposited by the operator into a coin depositing section (not shown).

The coins C deposited into the coin handling machine through the coin depositing section are fed by a coin transporting means (not shown) onto the rotatable disk 1 and fed into the coin sorting passage 2 by centrifugal force produced by the rotation of the rotatable disk 1. At this time, the clearance setting member 22 prevents two coins C from being simultaneously fed and the coins C are fed into the coin sorting passage 2 one by one.

The diameter, color, surface pattern and the magnetic property of the coin fed into the coin sorting passage 2 are detected by the sensor 5 and detection signals are output from the sensor 5 to the control unit 40.

Based on the detection signals input from the sensor 5, the control unit 40 compares detected optical data regarding the diameter, color and surface pattern of the coin C and detected magnetic data regarding the magnetic property of the coin C with the reference optical data and the reference magnetic data stored in the RAM 42.

As a result, when the control unit 40 judges that the detected optical data regarding the diameter, color and surface pattern of the coin C and the detected magnetic data regarding the magnetic property of the coin C do not substantially coincide with the reference optical data and the reference magnetic data of coins C of a certain denomination, since the coin C detected by the sensor 5 can be considered to be an unacceptable coin such as a counterfeit coin, a foreign coin or the like, the control unit 40 writes data indicating the result of judgment in the RAM 42.

To the contrary, when the control unit 40 judges that the detected optical data regarding the diameter, color and surface pattern of the coin C and the detected magnetic data regarding the magnetic property of the coin C substantially coincide with the reference optical data and the reference magnetic data of coins C of a certain denomination, it judges that the coin detected by the sensor 5 is an acceptable coin C.

When the control unit 40 judges that the coin detected by the sensor 5 is an acceptable coin C, it further reads reference damage level data corresponding to the denomination of the coin C and set by the damage level setting means 70 from the ROM 41 and compares the detected optical data of the coin C with the thus read reference damage level data, thereby discriminating whether or not the damage level of the coin C exceeds a predetermined level.

When the control unit 40 judges that the damage level of the coin C exceeds a predetermined level, it writes data indicating the result of judgment in the RAM 42.

To the contrary, when the control unit 40 judges that the damage level of the coin C is equal to or lower than the predetermined level, it writes no data in the RAM 42.

When the coin C is further fed by the first transporting belt 8 and the second transporting belt 9 along the reference guide rail 3 in the coin sorting passage 2 and the coin sensor 20 detects the coin C, a coin detection signal is output from the coin sensor 20 to the control unit 40.

When the control unit 40 receives the coin detection signal from the coin sensor 20, it accesses the RAM 42 and judges whether or not the discrimination data regarding the coin C are written in the RAM 42.

When the control unit 40 judges that no discrimination data regarding the coin C are written in the RAM 42, it outputs no signal.

Therefore, after the coin sensor 20 detects the coin C, the coin C is transported in the coin sorting passage 2 along the reference guide rail 3 and the cylindrical section 51 of the coin sorting member 54 disposed to be flush with the guide surface of the reference guide rail 3 and the coin C passes through the coin sorting device 50, while one edge portion thereof is being supported by the coin supporting surface 52*a* of the coin supporting section 52 of the coin sorting member 54 and the other edge portion thereof is being supported by the upper surface of the coin sorting passage 2 as shown in FIG. 8.

To the contrary, when the control unit 40 judges that the data indicating the result of discrimination that the coin C detected by the coin sensor 20 is an unacceptable coin C are written in the RAM 42, it outputs a drive signal to the gate solenoid 73 when the coin C passes through the coin sensor 20, thereby swinging the gate 63 so that the coin collecting passage 60 communicates with the unacceptable coin collecting passage 62 and outputs a drive signal to the pulse motor 72, thereby causing it to rotate the coin sorting member 54 clockwise in FIG. 8 about the horizontal shaft 53.

As a result, the coin supporting section 52 of the coin sorting member 54 which has supported one edge portion of the coin C by the coin supporting surface 52*a* thereof is rotated from the coin support position and the one edge portion of the coin C becomes no longer supported by the coin supporting surface 52*a* of the coin supporting section 52 which has been located at the coin support position. Further, as the coin sorting member 54 is rotated, the upper surface of the coin C is pressed downward by the coin press section 52*b* of the coin supporting section 52 to be next located at the coin support position, whereby the coin C is forcibly dropped into the coin sorting opening 57.

Since the gate 63 is located so that the coin collecting passage 60 communicates with the unacceptable coin collecting passage 62, the coin dropped into the coin sorting opening 57 is led into the unacceptable coin collecting passage 62 via the coin collecting passage 60 and collected in the unacceptable coin collecting box (not shown).

When the coin supporting section 52 of the coin sorting member 54 to be next located at the coin support position reaches the coin support position, the control unit 40 outputs a drive stop signal to the pulse motor 72, thereby causing it to stop the rotation of the coin sorting member 54.

On the other hand, when the control unit 40 judges that the data indicating the result of discrimination that the coin C detected by the coin sensor 20 is a coin whose damage level exceeds the predetermined level are written in the RAM 42, it outputs a drive signal to the pulse motor 72 when the coin C passes through the coin sensor 20, thereby causing it to rotate the coin sorting member 54 clockwise in FIG. 8 about the horizontal shaft 53.

As a result, the coin supporting section 52 of the coin sorting member 54 which has supported one edge portion of the coin C by the coin supporting surface 52*a* thereof is rotated from the coin support position and the one edge portion of the coin C becomes no longer supported by the coin supporting surface 52*a* of the coin supporting section 52 which has been located at the coin support position. Further, as the coin sorting member 54 is rotated, the upper surface of the coin C is pressed downward by the coin press section 52*b* of the coin supporting section 52 to be next located at the coin support position, whereby the coin C is forcibly dropped into the coin sorting opening 57.

Since the gate 63 is located so that the coin collecting passage 60 communicates with the damaged coin collecting passage 61, the coin dropped into the coin sorting opening 57 is led into the damaged coin collecting passage 61 via the coin collecting passage 60 and collected in the damaged coin collecting box (not shown).

When the coin supporting section 52 of the coin sorting member 54 to be next located at the coin support position reaches the coin support position, the control unit 40 outputs a drive stop signal to the pulse motor 72, thereby causing it to stop the rotation of the coin sorting member 54.

Coins C which were discriminated to be acceptable and passed through the coin sorting device 50 pass over the sensor 21, whereby the number thereof is counted for each denomination or the sum of the number thereof is counted and collected in a coin collecting box (not shown) connected to the downstream end portion of the coin sorting passage 2.

Thus, when all coins C deposited into the coin handling machine have been collected in the coin collecting box, the damaged coin collecting box 61 and the unacceptable coin collecting box 62, the handling operation of coins C of the coin handling machine is completed.

According to this embodiment, one edge portion of the coin C to be dropped in the coin sorting opening 57 and sorted is supported by the coin supporting surface 52*a* of the coin supporting section 52 of the coin sorting member 54 and the other edge portion thereof is supported by the upper surface of the coin sorting passage 2. Then, the pulse motor 72 is driven, whereby the coin sorting member 54 is rotated clockwise in FIG. 8 about the horizontal shaft 53. As a result, the coin supporting section 52 of the coin sorting member 54 which has supported one edge portion of the coin C by the coin supporting surface 52*a* thereof is rotated from the coin support position and the one edge portion of the coin C becomes no longer supported by the coin supporting surface 52*a* of the coin supporting section 52 which has been located at the coin support position. Further, as the coin sorting member 54 is rotated, the upper surface of the coin C is pressed downward by the coin press section 52*b* of the coin supporting section 52 to be next located at the coin support position, whereby the coin C is forcibly dropped into the coin sorting opening 57. Therefore, it is possible to reliably drop a coin C to be sorted in the coin sorting opening 57 and sort it.

Further, according to this embodiment, since the coin C to be sorted is forcibly dropped into the coin sorting opening 57 and sorted by rotating the coin sorting member 54 clockwise in FIG. 8 about the horizontal shaft 53, even if the coin C preceding a coin to be dropped into the coin sorting opening 11 and sorted or the following coin C is being transported with a short interval between itself and the coin C to be sorted, it is still possible to reliably drop only the coin C to be sorted into the coin sorting opening 57, thereby sorting it. Further, since the first transporting belt 8 and the second transporting belt 9 are not moved by the coin sorting member 54 in the widthwise direction of the coin sorting passage 2 and, therefore, the preceding coin C or the following coin C is not dropped into the coin sorting opening 57 by the first transporting belt 8 and the second transporting belt 9, it is possible to reliably drop only a coin C to be sorted into the coin sorting opening 57, thereby sorting it.

Furthermore, according to this embodiment, since the upper surface of the coin C to be sorted is pressed downward by the coin press section 52*b* of the coin supporting section 52 to be next located at the coin support position, whereby the coin C to be sorted is forcibly dropped into the coin sorting opening 57, it is possible to reliably drop the coin C to be sorted in the coin sorting opening 57 and sort it without making the coin sorting passage 2 considerably long. Therefore, the coin handling machine can be made markedly small even when the transporting speed of coins is increased in order to improve the handling efficiency of coins C because it is unnecessary to lengthen the coin sorting passage 2.

Moreover, according to this embodiment, since it is sufficient to form the coin sorting opening 57 so that the width thereof in a direction perpendicular to the coin transportation direction is smaller than the diameter of the smallest coin to be handled, the lower limit value of the diameter of the coin sorting opening 57 is not restricted. Therefore, since no restriction is imposed on diameters of coins to be handled, it is possible to sort coins having diameters greatly different from each other in accordance with their denominations in a desired manner.

The present invention has thus been shown and described with reference to specific embodiments. However, it should be noted that the present invention is in no way limited to the details of the described arrangements but changes and modifications may be made without departing from the scope of the appended claims.

For example, coins C other than coins C to be wrapped are forcibly dropped into the coin sorting opening 11 and sorted in the embodiment shown in FIGS. 1 to 7 and coins C whose damage level exceeds a predetermined level and unacceptable coins C such as a counterfeit coin, a foreign coin or the like are forcibly dropped into the coin sorting opening 57 and sorted in the embodiment shown in FIGS. 8 to 11. However, it is possible to forcibly drop coins C of a predetermined denomination into the coin sorting opening 11, 57 and coins to be sorted can be arbitrarily selected.

Further, in the embodiment shown in FIGS. 1 to 7, although the coin handling machine is constituted so as to wrap coins of the denomination specified by the operator, it is not absolutely necessary for the coin handling machine to have a coin wrapping function.

Furthermore, in the embodiment shown in FIGS. 1 to 7, although the coin sorting member 12 is rotated by the rotary solenoid 13 via the gear formed at the tip end portion 16*a* of the arm 16 and the gear of the engagement portion 12*b* meshing therewith, it is not absolutely necessary for the coin sorting member 12 to be rotated by the rotary solenoid 13 via the gear formed at the tip end portion 16*a* of the arm 16 and the gear of the engagement portion 12*b* meshing therewith and any drive mechanism can be selected for driving the coin sorting member 12.

Moreover, in the embodiment shown in FIGS. 8 to 11, although the coin sorting member 54 is rotated by the pulse motor 72 via the drum 55, the gear formed on the circumference of the drum 55 and the gear formed on the circumferential surface of the engagement member, it is not absolutely necessary for the coin sorting member 54 to be rotated by the pulse motor 72 via the drum 55, the gear formed on the circumference of the drum 55 and the gear formed on the circumferential surface of the engagement member and any drive mechanism can be selected for driving the coin sorting member 54.

Further, in the embodiment shown in FIGS. 8 to 11, although the cylindrical section 51 of the coin sorting member 54 is formed with the six coin supporting sections 52 extending radially, it is not absolutely necessary to form the cylindrical section 51 of the coin sorting member 54 with the six coin supporting sections 52 extending radially and the number of the coin supporting sections 52 can be arbitrarily selected.

Furthermore, one edge portion of the coin C becomes unsupported by rotating the coin sorting member 12 about the horizontal shaft 12*a* and swinging the coin supporting member 12*c* of the coin sorting member 12 downward in the embodiment shown in FIGS. 1 to 7 and one edge portion of the coin C becomes unsupported by rotating the coin sorting member 54 about the horizontal shaft 53 and swinging the coin supporting section 52 which has supported the one edge portion of the coin C downward in the embodiment shown in FIGS. 8 to 11. However, it is possible to forcibly drop a coin to be sorted into a coin sorting opening by providing a coin sorting member so as to be horizontally movable between a coin support position where it supports one edge portion of the coin and a retracted position horizontally retracted from the coin sorting passage 2, providing a coin press member for pressing the coin downward separately from the coin sorting member, and moving the coin press member so as to press the coin downward using a link mechanism in synchronism with the movement of the coin sorting member from the coin support position to the retracted position.

Moreover, in the embodiment shown in FIGS. 8 to 11, although the coin handling machine includes the damage level setting means 70 and the damage level of coins C to be sorted and collected can be arbitrarily set by the damage level setting means 70, it is not absolutely necessary for the coin handling machine to include the damage level setting means 70.

Further, in the embodiment shown in FIGS. 8 to 11, the coin collecting passage 60 of the coin handling machine is bifurcated into the damaged coin collecting passage 61 and the unacceptable coin collecting passage 62 and the gate 63 leads coins C whose damage level exceeds a predetermined level from the coin collecting passage 60 to the damaged coin collecting passage 61 and unacceptable coins C from the coin collecting passage 60 to the unacceptable coin collecting passage 62, whereby they are separately collected. However, it is not absolutely necessary to bifurcate the coin collecting passage 60 of the coin handling machine into the damaged coin collecting passage 61 and the unacceptable coin collecting passage 62, lead coins C whose damage level exceeds a predetermined level from the coin collecting passage 60 to the damaged coin collecting passage 61, lead unacceptable coins C from the coin collecting passage 60 to the unacceptable coin collecting passage 62 and separately collect them and it is possible to lead coins C whose damage level exceeds a predetermined level and unacceptable coins C to the same collecting box via the coin collecting passage 60 and then separate them.

Furthermore, in the embodiment shown in FIGS. 1 to 7, when the number of coins C to be wrapped passing through the sensor 20 provided downstream of the coin sorting device 10 is counted and it is judged that a predetermined number of coins C to be wrapped have been fed into the coin stacking section, the stopper (not shown) provided downstream of the sensor 21 is projected into the coin sorting passage 2, thereby preventing following coins C from being fed into the coin stacking section. However, it is possible to provide a stopper between the sensor 5 and the coin sorting device 10, lead all coins C passing through the sensor 5 to the coin sorting device 10 until the sensor 5 detects a predetermined number of coins C to be wrapped, allow only coins C to be wrapped to pass through the coin sorting device 10 and forcibly drop coins C other than those to be wrapped into the coin sorting opening 11, thereby sorting the coins C.

Moreover, in the embodiment shown in FIGS. 8 to 11, coins C discriminated to be acceptable are allowed to pass through the coin sorting device 50 and the sensor 21 and the number of acceptable coins C passing through the sensor 21 is counted for each denomination or the sum of the number of acceptable coins C passing through the sensor 21 is counted. However, it is possible to provide a stopper upstream or downstream of the coin sorting device 50, lead all coins C passing through the sensor 5 to the coin sorting device 50 until the number of acceptable coins C detected by the sensor 5 for each denomination or the sum of the number of acceptable coins C detected by the sensor 5 reaches a predetermined number, allow only acceptable coins C to pass through the coin sorting device 50 and forcibly drop coins C discriminated not to be acceptable into the coin sorting opening 57, thereby sorting the coins C.

According to the present invention, it is possible to provide a coin handling machine which can reliably drop a predetermined coin among coins fed into a coin sorting passage in a coin sorting opening formed in the coin sorting passage, thereby sorting it without making the machine large.

The invention claimed is:

1. A coin handling machine comprising a rotatable disk for receiving coins deposited into a coin handling machine and feeding out the coins into a coin sorting passage one by one by a centrifugal force produced by rotation of the rotatable disk, a reference guide rail for guiding the coins by an inner wall thereof, transporting belt means for transporting the coins while they are held between the coin sorting passage and themselves, and a sensor for detecting optical properties and magnetic properties of the coins, the coin handling machine further comprising a coin sorting opening formed in the coin sorting passage downstream of the sensor along the inner wall of the reference guide rail and a coin sorting member provided in the vicinity of a side portion of the coin sorting opening on the side of the reference guide rail, the coin sorting member comprising at least one coin supporting section having a coin supporting surface for supporting one edge portion of the coin being transported in the coin sorting passage and at least one coin press section for pressing the coin, the coin handling machine further comprising a coin sorting member driving means for moving the at least one coin supporting section between a coin support position where the coin supporting surface supports one edge portion of the coin being transported in the coin sorting passage and a retracted position where the coin supporting surface is retracted from the coin support position and dose not support the coin and moving the at least one coin press section so as to press the coin downward in synchronism with the movement of the coin supporting surface to the retracted position and a control means for driving the coin sorting member driving means based on detection signals from the sensor and the coin handling machine being constituted so as to forcibly drop the coin supported by the coin supporting surface into the coin sorting opening and sort it.

2. A coin handling machine in accordance with claim 1, wherein the coin sorting member comprises a coin supporting section having a coin supporting surface for supporting one edge portion of the coin being transported in the coin sorting passage and a coin press section integrally formed with the coin supporting section above the coin supporting surface and adapted for pressing the coin and the coin sorting member driving means is constituted so as to rotate the coin sorting member about a substantially horizontal axis.

3. A coin handling machine in accordance with claim 2, wherein the coin supporting section includes a side wall portion substantially perpendicular to the coin supporting surface, and the coin sorting opening and the coin sorting member are formed so that when the coin supporting section of the coin sorting member is located at the coin support position, the side wall portion of the coin supporting section is flush with the inner wall of the reference guide rail and a distance between a side portion of the coin sorting opening on the side of the coin sorting passage and the side wall portion of the coin supporting section is smaller than a diameter of the smallest coin to be handled.

4. A coin handling machine in accordance with claim 3, wherein the coin sorting member driving means is constituted as a rotary solenoid.

5. A coin handling machine in accordance with claim 4, wherein one end portion of an arm is fixed to an output shaft of the rotary solenoid, the coin supporting section includes an engagement portion formed with a gear and the gear on the engagement portion engages with a gear formed on the other end portion of the arm so that a driving force of the rotary solenoid can be transmitted to the coin sorting member.

6. A coin handling machine in accordance with claim 5, wherein the other end portion of the arm has a fan-shaped side cross section and the engagement portion of the coin supporting section has a fan-shaped side cross section.

7. A coin handling machine in accordance with claim 2, wherein the coin sorting member driving means is constituted as a rotary solenoid.

8. A coin handling machine in accordance with claim 7, wherein one end portion of an arm is fixed to an output shaft of the rotary solenoid, the coin supporting section includes an engagement portion formed with a gear and the gear on the engagement portion engages with a gear formed on the other end portion of the arm so that a driving force of the rotary solenoid can be transmitted to the coin sorting member.

9. A coin handling machine in accordance with claim 8, wherein the other end portion of the arm has a fan-shaped side cross section and the engagement portion of the coin supporting section has a fan-shaped side cross section.

10. A coin handling machine in accordance with claim 1, wherein the coin sorting member includes a cylindrical section and a plurality of coin supporting sections formed on the cylindrical section so as to radially extend, each of the plurality of coin supporting sections including a coin supporting surface for supporting one edge portion of a coin being transported in the coin sorting passage by the transporting belt means when the coin sorting member is located at the coin support position and a coin press section for pressing down the upper surface of the coin when the coin sorting member is moved to the retracted position, and the coin sorting member driving means is constituted so as to rotate the coin sorting member about a substantially horizontal axis.

11. A coin handling machine in accordance with claim 10, wherein the plurality of coin supporting sections are formed on the cylindrical section of the coin sorting member so that in synchronism with the movement of the coin supporting section which has been located at the coin support section thereof and has supported one edge portion of a coin being transported in the coin sorting passage with the coin supporting surface thereof toward the retracted position thereof, the coin press section of the coin supporting section neighboring the coin supporting section moving to the retracted position among the plurality of coin supporting sections can press downward the upper surface of the coin which has been supported by the coin supporting surface of the coin supporting section moving to the retracted position.

12. A coin handling machine in accordance with claim 11, wherein the coin sorting opening is formed and the coin sorting member is provided so that when the coin supporting section of the coin sorting member is located at the coin supporting position, the circumferential surface of the cylindrical section of the coin sorting member is flush with the inner wall of the reference guide rail and that a distance between the circumferential surface of the cylindrical section and a side portion of the coin sorting opening on the side of the coin sorting passage is smaller than a diameter of the smallest coin to be handled.

13. A coin handling machine in accordance with claim 12, wherein the coin sorting member driving means is constituted as a pulse motor.

14. A coin handling machine in accordance with claim 13, wherein a drum formed with a gear on a circumferential surface thereof is fixed to an output shaft of the pulse motor, a cylindrical engagement member formed with a gear on a circumferential surface thereof is integrally mounted on the coin sorting member, and the gear formed on the circumferential surface of the engagement member and the gear formed on the circumferential surface of the drum are meshed so that a driving force of the pulse motor can be transmitted to the coin sorting member.

15. A coin handling machine in accordance with claim 14, wherein the pulse motor is constituted to rotate the coin sorting member in such a manner that the plurality of coin supporting sections are sequentially located at the coin supporting position.

16. A coin handling machine in accordance with claim 13, wherein the pulse motor is constituted to rotate the coin sorting member in such a manner that the plurality of coin supporting sections are sequentially located at the coin supporting position.

17. A coin handling machine in accordance with claim 11, wherein the coin sorting member driving means is constituted as a pulse motor.

18. A coin handling machine in accordance with claim 17, wherein a drum formed with a gear on a circumferential surface thereof is fixed to an output shaft of the pulse motor, a cylindrical engagement member formed with a gear on a circumferential surface thereof is integrally mounted on the coin sorting member, and the gear formed on the circumferential surface of the engagement member and the gear formed on the circumferential surface of the drum are meshed so that a driving force of the pulse motor can be transmitted to the coin sorting member.

19. A coin handling machine in accordance with claim 18, wherein the pulse motor is constituted to rotate the coin sorting member in such a manner that the plurality of coin supporting sections are sequentially located at the coin supporting position.

20. A coin handling machine in accordance with claim 17, wherein the pulse motor is constituted to rotate the coin sorting member in such a manner that the plurality of coin supporting sections are sequentially located at the coin supporting position.

21. A coin handling machine in accordance with claim 10, wherein the coin sorting opening is formed and the coin sorting member is provided so that when the coin supporting section of the coin sorting member is located at the coin supporting position, the circumferential surface of the cylindrical section of the coin sorting member is flush with the inner wall of the reference guide rail and that a distance between the circumferential surface of the cylindrical section and a side portion of the coin sorting opening on the side of the coin sorting passage is smaller than a diameter of the smallest coin to be handled.

22. A coin handling machine in accordance with claim 21, wherein the coin sorting member driving means is constituted as a pulse motor.

23. A coin handling machine in accordance with claim 22, wherein a drum formed with a gear on a circumferential surface thereof is fixed to an output shaft of the pulse motor, a cylindrical engagement member formed with a gear on a circumferential surface thereof is integrally mounted on the coin sorting member, and the gear formed on the circumferential surface of the engagement member and the gear formed on the circumferential surface of the drum are meshed so that a driving force of the pulse motor can be transmitted to the coin sorting member.

24. A coin handling machine in accordance with claim 23, wherein the pulse motor is constituted to rotate the coin sorting member in such a manner that the plurality of coin supporting sections are sequentially located at the coin supporting position.

25. A coin handling machine in accordance with claim 22, wherein the pulse motor is constituted to rotate the coin sorting member in such a manner that the plurality of coin supporting sections are sequentially located at the coin supporting position.

26. A coin handling machine in accordance with claim 10, wherein the coin sorting member driving means is constituted as a pulse motor.

27. A coin handling machine in accordance with claim 26, wherein a drum formed with a gear on a circumferential surface thereof is fixed to an output shaft of the pulse motor, a cylindrical engagement member formed with a gear on a circumferential surface thereof is integrally mounted on the coin sorting member, and the gear formed on the circumferential surface of the engagement member and the gear formed on the circumferential surface of the drum are meshed so that a driving force of the pulse motor can be transmitted to the coin sorting member.

28. A coin handling machine in accordance with claim 27, wherein the pulse motor is constituted to rotate the coin sorting member in such a manner that the plurality of coin supporting sections are sequentially located at the coin supporting position.

29. A coin handling machine in accordance with claim 26, wherein the pulse motor is constituted to rotate the coin sorting member in such a manner that the plurality of coin supporting sections are sequentially located at the coin supporting position.

* * * * *